US006163984A

United States Patent [19]

Faber et al.

[11] Patent Number: 6,163,984

[45] Date of Patent: Dec. 26, 2000

[54] SNOWSHOE WITH PIVOTABLE HARNESS HINGED ON A SEMI-RIGID DECKING

[76] Inventors: Guy Faber, 13110, Desportes, Neufchâtel, (Quebec), Canada, G2A 3Y7; Richard Faber, 276, Cloutier, Loretteville, (Quebec), Canada, G2A 2J6

[21] Appl. No.: 09/455,478

[22] Filed: Dec. 6, 1999

[51] Int. Cl.[7] ..... A43B 5/04

[52] U.S. Cl. ..... 36/125; 36/124

[58] Field of Search ..... 36/122, 123, 124, 36/125

[56] References Cited

U.S. PATENT DOCUMENTS

| | | |
|---|---|---|
| 1,613,576 | 1/1927 | Burgess . |
| 2,738,596 | 3/1956 | Walsh . |
| 4,045,889 | 9/1977 | Woolworth . |
| 4,259,793 | 4/1981 | Morgan, Jr. et al. . |
| 4,270,928 | 6/1981 | Faber et al. . |
| 4,271,609 | 6/1981 | Merrifield . |
| 4,348,823 | 9/1982 | Knapp et al. . |
| 5,469,643 | 11/1995 | Forrest . |
| 5,493,794 | 2/1996 | McKenzie et al. . |
| 5,517,772 | 5/1996 | Anderson . |
| 5,542,197 | 8/1996 | Vincent . |
| 5,659,981 | 8/1997 | Liautaud . |
| 5,809,668 | 9/1998 | Kiniry et al. . |
| 6,003,249 | 12/1999 | Watson . |
| 6,112,436 | 9/2000 | Quellais . |

FOREIGN PATENT DOCUMENTS

| | | |
|---|---|---|
| 993468 | 7/1976 | Canada . |
| 1039764 | 10/1978 | Canada . |
| 1074356 | 3/1980 | Canada . |
| 2185852 | 3/1999 | Canada . |

OTHER PUBLICATIONS

Mountain Access– Rotating Toe cord.
New Snowshoes for every Man, woman and child Snowshoe Anatomy.
Tubbs Snowshoes (1996–1997).
Snow Trail—Winter Trail.
Sherpa Dealer Guide—(1999–2000).
MSR Denali Snowshoes.
Yatra Trainer, Hantra Racer (Sherpa).
Biothane Pivot Belt.
Romp Snowshoes.
Mountain Safety Research (1996—pp. 30, 31).
Northern Lites World's Lightest Snowshoes.
TSL Snowshoe (1996–1997).
Redfeather Snowshoes.
Nanuk Winter Sportsystems.
Sherpa Dealer Program (1998–1999).
The Guide for Snowshoeing (Atlas 1997).
Snow Winter Mountain Wild Trail (G & V Snowshoes).

(List continued on next page.)

*Primary Examiner*—Ted Kavanaugh
*Attorney, Agent, or Firm*—François Martineau

[57] ABSTRACT

The snowshoe includes a closed loop frame carrying an intermediate decking attached to the frame. The decking is made from a full sheet of semi-flexible plastic material, and is peripherally attached to the frame. A toe hole is provided at the front end portion of the decking. On its edge rearwardly adjacent to the toe hole, the decking forms an integral first hinge, in the form of an arcuate boss having an upwardly convex upper surface, and a downwardly concave lower surface. A harness is pivotally attached to the decking. The harness has a cradle plate made of semi-flexible plastic material, and a flexible strap attached thereto. The cradle has an upper surface for receiving the foot of the person wearing the snowshoe, and a lower surface which forms an integral second hinge, in the form of an arcuate seat and a pair of cylindrical lugs spacedly adjacent to the arcuate seat. The cradle second hinge is releasably engaged in the decking first hinge, the decking arcuate boss being slidingly engaged between the cradle lugs and the cradle seat, so that the decking supports the cradle.

19 Claims, 6 Drawing Sheets

OTHER PUBLICATIONS

Tubbs Snowshoes (Tubb Snowshoe Company, 1997).
Raquettes a neige Snowshoes VPI Evasion.
Romp Snowshoes.
Mountain Access.
Faber Showshoes—Raquettes a neige (Faber & Co Inc 1994).

New PC snowhoe takes off the weight (Injection Molding, 1999).

TCT Case Study (Time–Compression Technologies, p. 28.

The New TubbScout.

Baldas Snowshoes (Baldas U.S.A. Inc.).

SNOWSHOE WITH PIVOTABLE HARNESS HINGED ON A SEMI-RIGID DECKING

FIELD OF THE INVENTION

The present invention relates to snowshoes, and more particularly to a snowshoe with a pivotable harness hinged on a semi-rigid decking.

BACKGROUND OF THE INVENTION

Canadian patent application No. 2,185,852, filed by G. Faber and R. Faber in 1996 and published Mar. 19, 1998, shows a snowshoe comprising a peripheral loop frame having front and rear crossbars, between which an intermediate monolithic decking made of plastic is supported. A harness, e.g. in the form of straps or laces, is provided at the front end portion of the intermediate decking, where a person's foot may be attached so as to allow the person to walk with the snowshoe, the forefoot pivoting alternately into and out of a toe hole provided in the decking, as known in the art A problem associated with such a snowshoe, is that the lateral stability of the foot is often poor, i.e. the foot may undesirably pivot about a substantially vertical axis on the snowshoe. Consequently, the foot and the snowshoe may become misaligned, hampering the walking movement of the person using the snowshoe.

To obviate such a problem, snowshoes have been provided with rigid transverse rods on which a rigid harness is hinged, the user's foot resting on the harness and the rod and consequently being guided in its pivotal displacement by the hinged attachment of the harness on the transverse rod, to prevent misalignment of the foot relative to the snowshoe. However, due to the rigidity of the transverse rod and since this rod becomes periodically loaded and unloaded with the person's weight during gait, accidental structural failure of either the rod or the snowshoe frame are likely to eventually occur under the rod being subjected to stress concentrations, especially when the snowshoe is used on uneven ground terrain. For example, if the snowshoe comes to rest mainly on a single point on the transverse rod, such as when the snowshoe bears on a pointed rock which is not covered by snow, then the stress concentrations on the transverse rod supporting the harness, and on the frame in the area supporting the transverse rod, can become very significant and can result in permanent deformation of the transverse rod and/or breakage of the transverse rod or the frame.

Canadian patent No. 993,468 issued in 1976 to W. N. Prater discloses a snowshoe including a webbing or lacing supporting a transverse rod located adjacent to and rearwardly of the front toe hole. The transverse rod extends short of the frame longitudinal side portions, the rod being provided at its extremities with eyelets that engage a portion of the snowshoe lacing exclusively destined to support the transverse rod. The transverse rod pivotally supports a harness or binding, to allow a foot operatively engaged in the harness to pivot about the transverse rod during gait. The foot is thus not prone to accidental and undesirable lateral shifting during gait, since its pivotal movement is guided by the foot harness being pivoted on the transverse rod. In the Prater patent, the fact that the transverse rod is not supported by the frame helps prevent undesirable stress concentrations from being exerted on the snowshoe frame, since the slight flexibility of the lacing can partly compensate locally uneven terrain to help prevent excessive stress concentrations.

However, a first disadvantage of the Prater snowshoe is that its assembly is heavy, is further complex and thus more expensive, due to the transverse rod which has to be attached to the lacing. Moreover, the metallic rod may be prone to corrosion, which is of course highly undesirable since snowshoes will often be subjected to humid or wet conditions. Specific anticorrosion metallic material has to be used, which is more expensive. Another disadvantage of the Prater snowshoe is that the rigid transverse rod will still be subjected to stress concentrations, due to the load of the person's foot on the rod and to the rigidity of the latter. This stress concentration is not likely to be as important than if the rod was directly attached to the snowshoe frame, but the stress on the rod per se will remain significant, due to its rigidity. The rigid rod may moreover induce important strain to the lacing linking it to the frame, under particularly important loads being applied on a single point of the rod.

OBJECTS OF THE INVENTION

It is an object of the present invention to provide a snowshoe with semi-flexible decking having a pivotable harness mounted thereon, with the snowshoe remaining partly flexible at the harness pivotal attachment.

It is an object of the present invention to provide a snowshoe with a pivotable harness of simple construction.

SUMMARY OF THE INVENTION

The present invention relates to the combination of a semi-flexible snowshoe decking for attachment to a snowshoe, and a harness for releasable engagement therein of a person's foot, said semi-flexible decking being substantially flat and defining a front and a rear end portions, said decking comprising a toe hole and a first hinge member integrally formed in said decking and located rearwardly adjacent to said toe hole;

said harness having a semi-flexible foot cradle for resting the person's foot thereon and an attachment member carried by said foot cradle for releasable attachment of said harness to the person's foot, said cradle defining a front and a rear end portions and comprising a second hinge member integrally formed in said cradle intermediate said front and rear end portions; wherein said second hinge member is operatively mounted to said first hinge member for relative movement of said cradle relative to said decking between a first limit position, in which said cradle rear end portion abuts against said decking and in which said cradle front end portion is generally located over said toe hole, and a second limit position, in which said cradle extends through said toe hole with said cradle rear end portion extending spacedly over said decking and with said cradle front end portion extending through and beyond said toe hole; and wherein due to the intrinsic flexibility of said cradle and of said decking, said first and second hinge members will yieldingly yet resiliently flex under loads being applied thereon, to more evenly distribute stresses induced therein.

Preferably, said second hinge member is operatively pivotally mounted to said first hinge member to allow pivotal displacement of said cradle between said first and second limit positions.

Preferably, said cradle and said decking are made from a semi-flexible plastic material.

Preferably, said first hinge member comprises an elongated boss integrally formed transversely in said decking, said boss being semi-cylindrical and defining an upwardly convex upper surface and a downwardly concave lower surface, and wherein said second hinge member comprises a cylindrical lug member and an arcuate seat spacedly adjacent to and coaxial with said lug member, said boss being sized to fit between said lug member and said seat for sliding releasable engagement therebetween, said harness thus being selectively manually removable from said decking.

Preferably, said cradle comprises a substantially flat sheet member that defines an upper and a lower surface, said second hinge member being provided on said cradle lower surface and said cradle being provided with longitudinal toothed ridges on its lower surface frontwardly of said second hinge member, for gripping engagement on the snow during gait.

Preferably, said lug member comprises a few axially aligned, spaced-apart cylindrical lugs.

Preferably, said cradle comprises a few openings each located over a corresponding lug, for enhancing the flexibility of said cradle in the area adjacent said second hinge member, and for facilitating the production manufacturing moulding of said cradle.

Preferably, said cradle further comprises a number of longitudinally aligned reinforcing ribs located on each side of said openings, for enhancing the longitudinal rigidity of said cradle to help prevent accidental bending about a transverse axis, while not hampering the transverse flexibility of said cradle to allow said cradle to bend about a longitudinal axis.

Preferably, said cradle front end portion includes an abutment shoulder for abutment thereon of the foremost portion of the person's foot.

Preferably, said cradle lower surface comprises a few cleats, to further enhance the gripping action of said cradle during gait.

Preferably, said cradle upper surface is provided with studs, to prevent the person's foot from accidentally sliding on said cradle upper surface.

Preferably, said decking defines an upper surface and a lower ground-bearing surface, said lower surface being provided with a number of cleats projecting therefrom.

Preferably, said decking upper surface includes a number of studs to prevent the person's foot from accidentally sliding on said cradle upper surface.

The present invention also relates to a snowshoe for releasable attachment to a person's foot, comprising:

a closed rigid loop frame having a longitudinal axis;

a semi-flexible, substantially flat decking attached inside said loop frame, said decking defining a front and a rear end portions and comprising a toe hole and a first hinge member integrally formed in said decking and located rearwardly adjacent to said toe hole;

a harness having a semi-flexible foot cradle for resting the person's foot thereon and an attachment member carried by said foot cradle for releasable attachment of said harness to the person's foot, said cradle defining a front and a rear end portions and comprising a second hinge member integrally formed in said cradle intermediate said front and rear end portions; wherein said second hinge member is operatively mounted to said first hinge member for relative movement of said cradle relative to said decking between a first limit position, in which said cradle rear end portion abuts against said decking and in which said cradle front end portion is generally located over said toe hole, and a second limit position, in which said cradle extends through said toe hole with said cradle rear end portion extending spacedly away from said decking and with said cradle front end portion extending through and beyond said toe hole; and wherein due to the intrinsic flexibility of said cradle and of said decking, said first and second hinge members will yieldingly yet resiliently flex under loads being applied thereon, to more evenly distribute stresses induced therein.

Preferably, said second hinge member is operatively pivotally mounted to said first hinge member to allow pivotal displacement of said cradle between said first and second limit positions.

Preferably, said cradle and said decking are made from a semi-flexible plastic material.

Preferably, said first hinge member comprises an elongated boss integrally formed transversely in said decking, said boss being semi-cylindrical and defining an upwardly convex upper surface and a downwardly concave lower surface, and wherein said second hinge member comprises a cylindrical lug member and an arcuate seat spacedly adjacent to and coaxial with said lug member, said boss being sized to fit between said lug member and said seat for sliding releasable engagement therebetween, said harness thus being selectively manually removable from said decking.

Preferably, said cradle comprises a substantially flat sheet member that defines an upper and a lower surface, said second hinge member being provided on said cradle lower surface and said cradle being provided with longitudinal toothed ridges on its lower surface frontwardly of said second hinge member, for gripping engagement on the snow during gait.

Preferably, said decking is formed from a full substantially flat sheet member, and wherein said loop frame further comprises a front and a rear crossbar transversely extending therein and defining a central area between said front and rear crossbars in which said decking is installed, a front area frontwardly of said front crossbar in which an additional front decking is installed, and a rear area rearwardly of said rear crossbar in which an additional rear decking is installed.

DETAILED DESCRIPTION OF THE EMBODIMENTS

Figure 1:
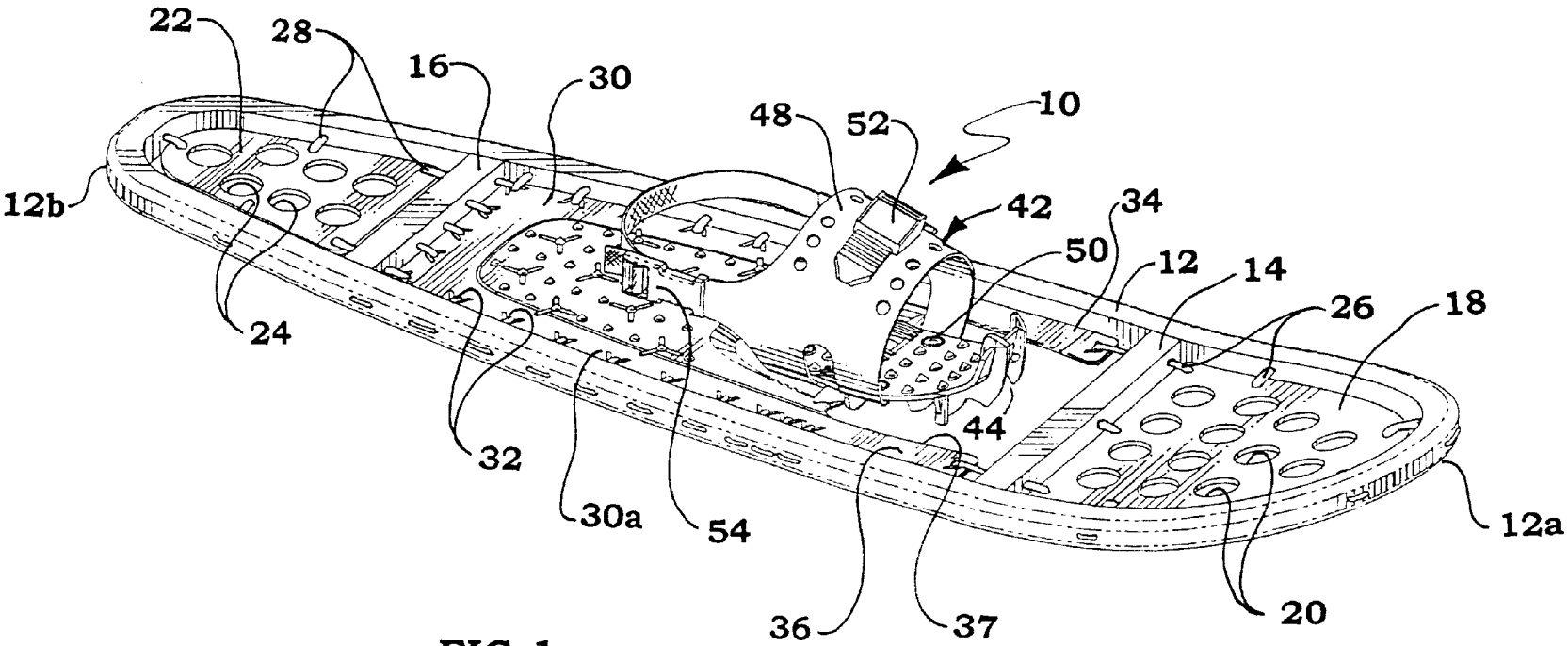
FIG. 1 is a perspective view of a snowshoe according to the invention.

FIG. 1 shows a snowshoe 10 according to the invention, including an elongated rigid peripheral loop frame 12 having a front portion 12*a* and a rear portion 12*b*. A front and a rear rigid crossbars 14, 16 transversely bridge loop frame 12, as known in the art. Snowshoe 10 further comprises a front semi-flexible sheet decking 18 provided with a number of through-holes 20 therein, and a rear semi-flexible sheet decking 22 provided with a number of through-holes 24 therein. Front decking 18 is attached to the surrounding front portion 12*a* of frame 12 and to front crossbar 14 by means of filament ties 26, and rear decking 22 is attached to the surrounding rear portion 12*b* of frame 12 and to rear crossbar 16 by means of similar filament ties 28.

Figure 2:
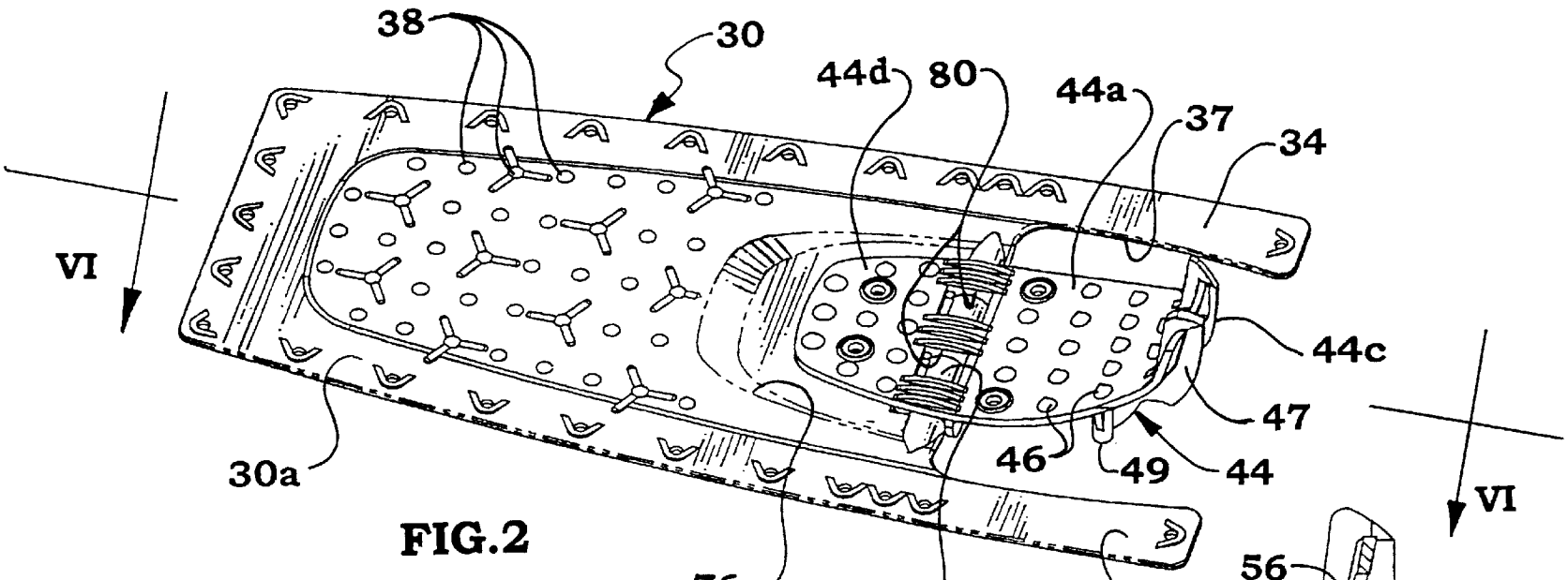
FIG. 2 is a top perspective view of the intermediate decking of the snowshoe of FIG. 1, and further showing the cradle plate of the harness operatively mounted to the decking.
Figure 3:
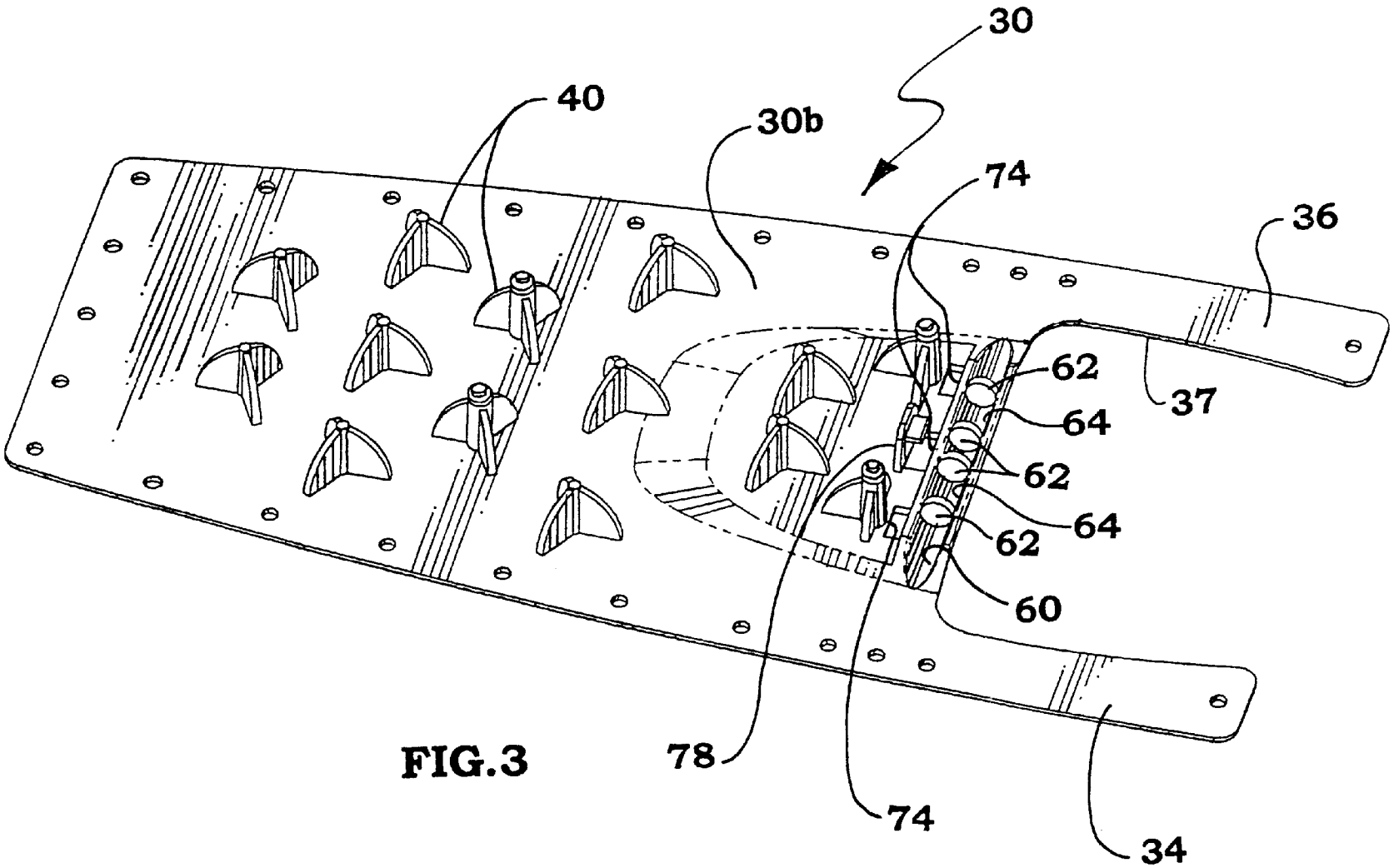
FIG. 3 is a bottom perspective view of the intermediate decking of the snowshoe of FIG. 1.

According to the invention, an intermediate semi-flexible sheet decking 30 made of plastic material is attached to the intermediate surrounding portion of frame 12, between front and rear crossbars 14, 16, with a number of peripherally spaced filament ties 32 similar to ties 26, 28. Intermediate decking 30 is preferably full, i.e. without pierced through-holes such as holes 20, 24 provided on front and rear deckings 18, 22. FIGS. 1 to 3 further show that intermediate decking 30 has a generally rectangular shape and is provided with a pair of frontwardly projecting arms 34, 36 attached at their front end portion to front crossbar 14. A toe hole 37 is defined between arms 34, 36, immediately behind front crossbar 14. Decking 30 defines an upper face 30*a* provided with a number of short friction studs 38 (FIG. 2) for preventing accidental sliding of the user's boot thereon, and a lower face 30*b* provided with a number of cleats 40 (FIG. 3) for enhancing the traction of snowshoe 10 on snow-covered terrain, and especially over inclined surfaces.

According to the invention, snowshoe 10 is further provided with a harness 42 pivotally attached to decking 30, in a manner described hereinafter. As shown in FIGS. 1, 2, 4 and 5, harness 42 includes a semi-flexible cradle plate 44 which has an upper surface 44*a* provided with friction studs 46 and a lower surface 44*b* provided with, inter alia, toothed ridges 47 and studs 49 perpendicularly projecting from the cradle lower surface 44*b* for enhanced gripping action during gait. Cradle 44 is generally elongated, and defines front and rear end portions 44*c*, 44*d*. A suitable strap member 48 is attached, e.g. bolted with bolts 50 engaging the strap member 48 and holes 51 of cradle 44, so as to allow the forefoot portion of a booted foot to rest on cradle 44, while strap member 48 will be releasably attached over and around the foot. A latch tie member 52 or other suitable attachment member is provided on strap member 48 to allow easy insertion or release of the foot in harness 42, and a conventional strap adjustment member 54 allows adjustment of the size of strap member 48 to fit feet of different sizes. Cradle 44 further comprises an arcuate abutment shoulder 56 upwardly extending from its front end portion 44*c*, on which the frontmost extremity of the booted foot is destined to frontwardly abut when it operatively engages harness 42.

Figure 8:
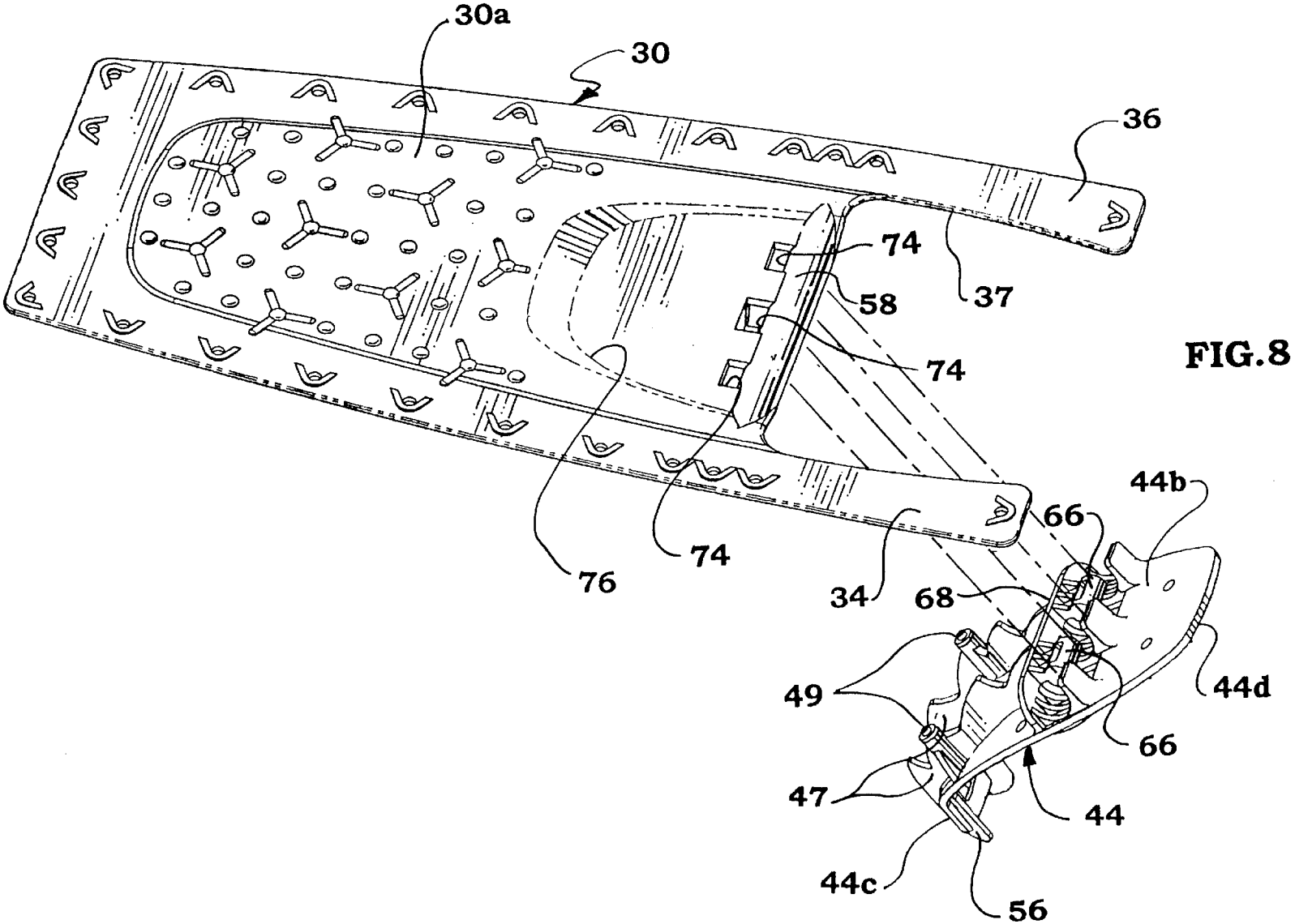
FIG. 8 is an exploded top perspective view of the decking and harness cradle plate assembly.

FIGS. 3 and 8 show that snowshoe 10 comprises a first transverse hinge member integrally molded in decking 30 along its edge rearwardly adjacent to toe hole 37, in the form of a semi-cylindrical hinge boss 58 being upwardly convex, with boss 58 defining on its underface a complementary semi-cylindrical downwardly concave groove 60 having four small radial discs 62, with the two laterally outward pairs of adjacent discs 62 forming two spaced-apart lug seats 64, 64.

Figures 4, 5:
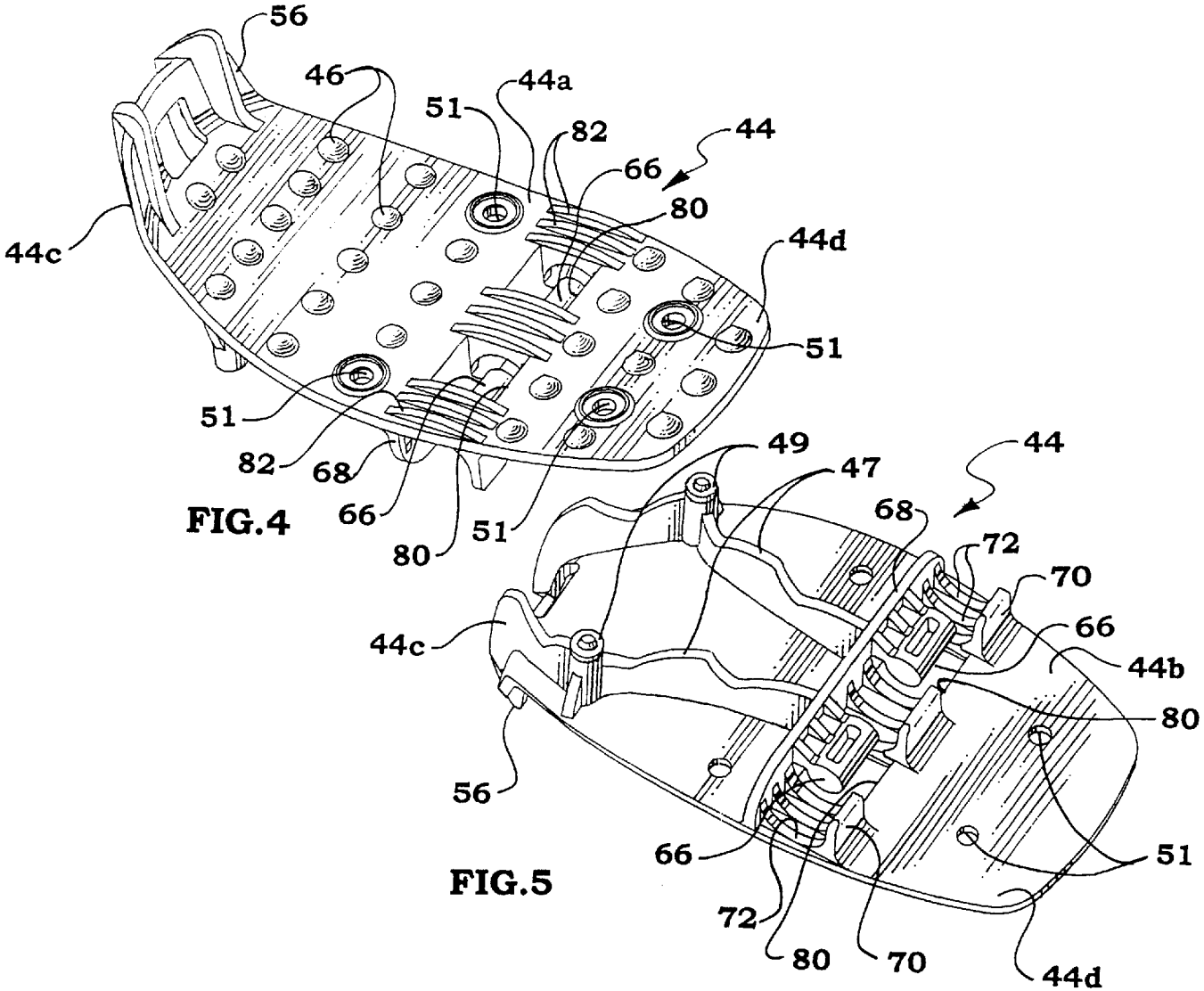
FIGS. 4 and 5 are enlarged top and bottom perspective views, respectively, of the cradle plate of the harness of the snowshoe of FIG. 1.

FIGS. 4, 5 and 8 show that the intermediate portion of cradle plate 44 includes, on its lower surface 44*b*, a second hinge member in the form of a pair of spaced-apart short cylindrical axially-aligned lugs 66, 66 rearwardly integrally carried by a transverse support fin 68 integrally perpendicularly projecting from the cradle lower surface 44*b*. Three spaced-apart finger plates 70 also integrally perpendicularly project from the cradle underface 44*b*, spacedly parallel to fin 68. Longitudinal arcuate downwardly concave ribs 72 bridge finger plates 70 and fin 68, so as to define a boss seat.

As shown in the drawings, cradle 44 engages decking 30 so as to allow pivotal displacement of cradle 44 through the instrumentality of the interlocking first and second hinge members. More particularly, lugs 66 are snugly seated in lug seats 64 so as to allow pivotal displacement of cradle 44 about the axis of lugs 66, the latter sliding in their lug seats 64 when rotating; and the boss seat formed by the cradle ribs 72 is snugly engaged by the decking boss 58, the boss 58 thus being trapped between the complementarily formed cradle lugs 66 and cradle ribs 72.

Figure 6:
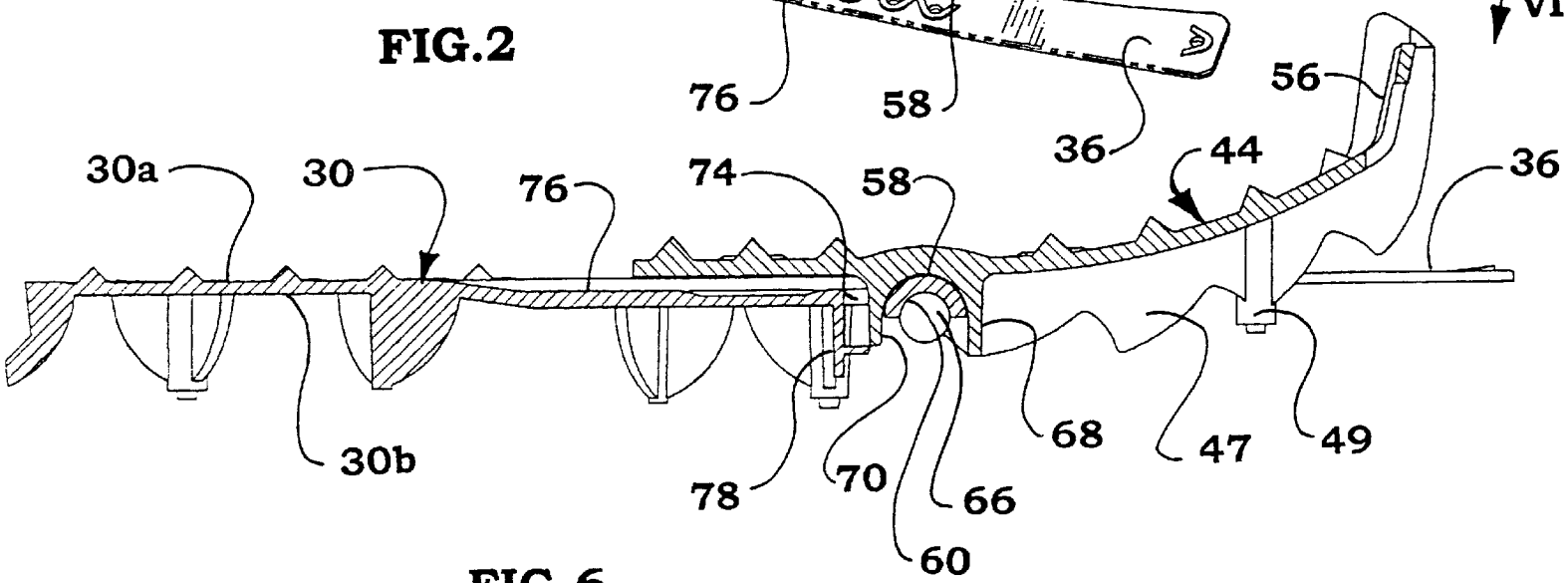
FIG. 6 is an enlarged partial longitudinal cross-sectional view of the snowshoe taken along line VI—VI of FIG. 2, showing more particularly the harness cradle plate hingedly engaging the snowshoe decking in a first limit position in which it is generally aligned with the snowshoe decking.
Figure 7:
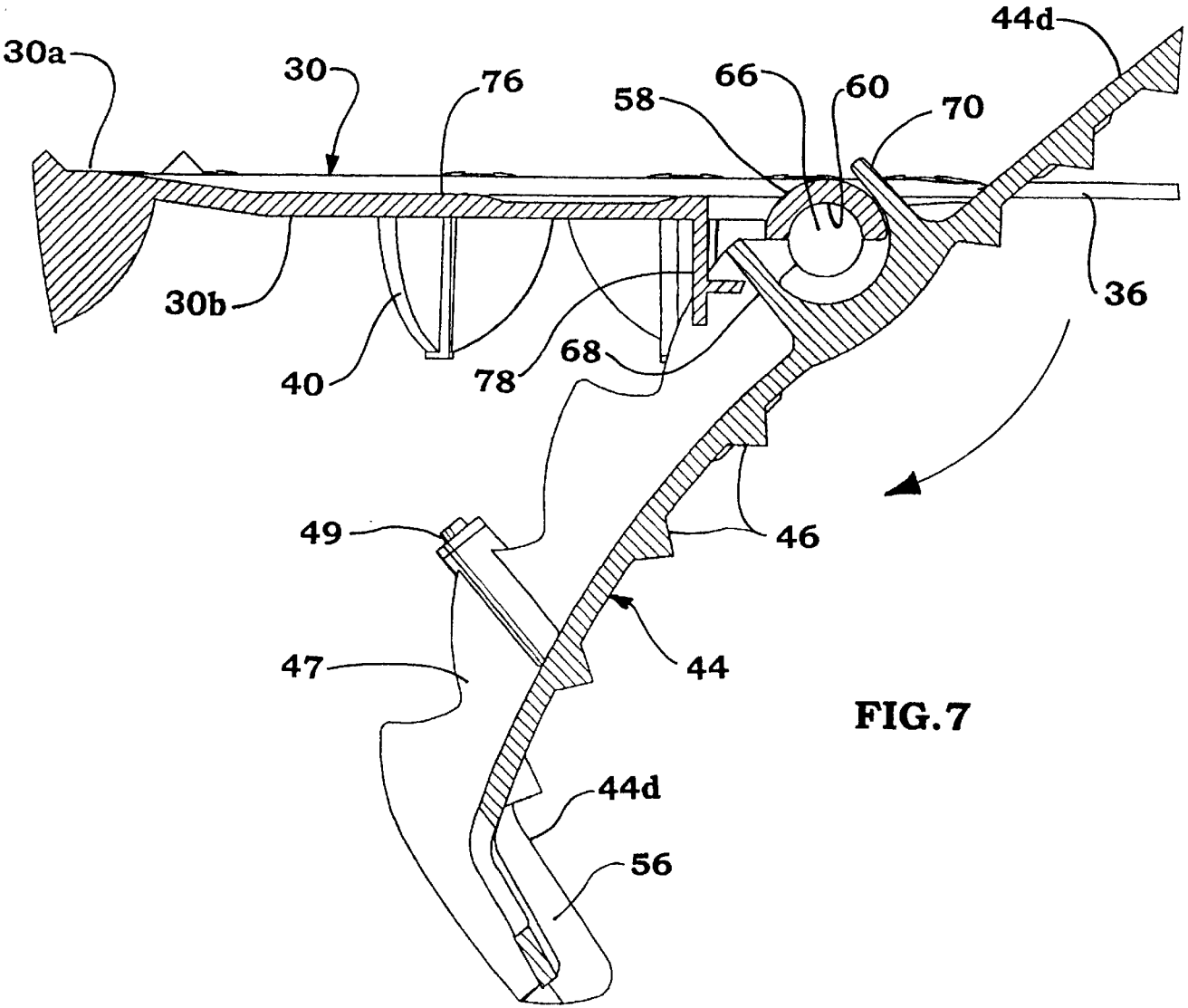
FIG. 7 is similar to FIG. 6, but being at an enlarged scale and with the harness cradle plate being shown in a second downwardly pivoted limit position.

In use, cradle 44 is pivotable between a first limit position shown in FIGS. 1, 2 and 6, in which the cradle lower surface 44*b* abuts at its rear end portion 44*d* onto the decking upper surface 30*a* and in which the cradle front end portion 44*c* is located generally over toe hole 37, with cleats 49 and ridges 47 partly downwardly extending through toe hole 37 (FIG. 6); and a second limit position shown in FIG. 7, in which the cradle front end portion 44*c* is pivoted downwardly through and well beyond toe hole 37, until ridges 47 or fin 68 abut against the decking lower surface 30*b*. When the snowshoe 10 is worn, cradle 44 will never reach this second limit position, as it will be pivoted from the first limit position to a position intermediate the first and second limit position during gait.

As shown in the drawings, decking 30 is provided with three spaced-apart apertures 74 located rearwardly of boss 58 in which finger plates 70 are engageable when cradle 44 is in its first limit position. Finger plates 70 are provided with such a length as to help prevent accidental disengagement of cradle plate 44 from decking 30 when cradle plate is pivoted towards its second limit position, although it does not prevent disengagement of the cradle plate 44 from decking 30 once cradle plate 44 reaches its second limit position, as described hereinafter. Indeed, as can be deducted from FIG. 7, when cradle plate 44 is pivoted into a substantially perpendicular position relative to decking 30, boss 58 then becomes trapped between finger plates 70 and lugs 66, since the seat ribs 72 do not extend the full length of finger plates 70.

As further shown in the drawings, decking 30 is provided with an upwardly concave depression 76 sized to receive therein the cradle rear end portion 44*d*, for the cradle plate upper surface 44*a* and decking upper surface 30*a* to be substantially coplanar. Thus, the forefoot and the heel of the person wearing the snowshoe 10 can be at a same level when flatly resting on the ground. Furthermore, as can be best seen in FIGS. 6 and 7, boss 58 is formed at the front end portion of depression 76, and the apex of boss 58 is at a same level with the non-depressed upper surface 30*a* of decking 30, to allow the foot supported by cradle 44 to pivot about the first and second hinge members from a flat initial position.

Cradle 44 can be selectively removed from and installed on decking 30. Indeed, as shown in FIGS. 7 and 8, when cradle 44 is pivoted into its second limit position, lugs 66 may be downwardly and frontwardly—relative to decking 30—released from their seats 64 in groove 60, since the finger plates 70 then clear the boss 58 and can then slide therealong at approximately a 45° angle relative to the decking 30. Thus, harness 42 can be removed through toe hole 37, and can be re-installed on decking 30 by reversely accomplishing the same steps. It is understood that cradle 44 cannot be accidentally released from decking 30 during use, since the second limit position of cradle 44, as shown in FIG. 7, cannot be reached when snowshoe 10 is worn due to the obstructing presence of the snowshoe decking 30 which would abut on the knee of the user before his foot could be pivoted far enough to reach the cradle second limit position. To prevent accidental release of cradle 44 from decking 30 when snowshoe 10 is not being worm, i.e. when it is carried, a semi-rigid L-shaped stopper 78 is integrally provided on the underface 30*b* of decking 30; rearwardly of the central opening 74. As shown in FIG. 7, cradle 44 will be prevented from being released by the abutment of the transverse cradle fin 68 on stopper 78. Cradle 44 can be forced against stopper 78, which will resiliently yield to allow the release of cradle 44 from decking 30. Thus, cradle 44 can be selectively manually removed from decking 30, but is not likely to accidentally be released.

FIGS. 2, 4 and 5 show that cradle 44 is provided with two openings 80, 80 in register with lugs 66. Openings 80 serve a dual purpose: firstly, they provide an enhanced flexibility in the area of cradle 44 which is adjacent to the pivotal axis of cradle 44 on decking 30, for reasons which will be detailed hereinafter; and secondly, holes 80, 80 facilitate the molding operation of cradle 44, and more particularly of the underlying lugs 66. Longitudinally-extending short arcuate reinforcing ribs 82 (FIG. 4) are provided on the upper surface 44*a* of cradle 44, on one side and the other of each hole 80. Holes 80 are not likely to promote snow accumulation between cradle 80 and the person's boot, since snow will be allowed to evacuate through holes 80 during gait, especially when cradle 44 is pivoted through toe hole 37 during toe-off, the snow then being allowed to evacuate through holes 80 rearwardly along decking 30 and under cradle 44.

An important aspect of the present invention relies on the semi-flexible nature of both the decking 30 and the cradle 44. It is understood that the remaining portion of harness 42, namely the strap member 48, is flexible, and thus the overall rigidity of harness 42 is governed by cradle 44. As known in, the art, the flexibility of the decking allows the load-borne stress induced therein to be more evenly distributed over the decking surface, to prevent structural failure of the decking when loaded wish a person's weight The hinge portion of snowshoe 10, namely the first and the second hinge members, is also semi-flexible, which allows the load-borne stresses induced therein to also be more evenly distributed, thus minimizing the likelihood of accidental structural failure of the first and second hinge members. Indeed, the first hinge member of snowshoe 10 is molded integrally in the same plastic material as the decking 30, and thus has an intrinsic flexibility which allows it to slightly bend when loaded. Cradle 44 is also made from a plastic material, and may also bend under its intrinsic flexibility to compensate for any bending of the underlying boss 58, so that the first and second hinge members remain interlocked during use while both simultaneously bending slightly under loaded conditions.

It is desirable that cradle 44 be sufficiently rigid to prevent undesirable excessive bending of cradle 44 during gait, since cradle 44 must support the foot and allow a relatively rigid pivotal motion of the foot; while simultaneously allowing a slight transverse bending along first hinge member, as described hereinabove. Thus, the ridges 47 longitudinally extending on the cradle front end portion 44*c* help prevent cradle 44 from bending along a transversal axis under the load of the person applied on his or her forefoot. However, the holes 80 help provide a greater flexibility in the first hinge member area of cradle 44, which overlies boss 58, so as not to prevent the necessary slight bending of boss 58.

Ribs 72 forming the boss seat on the cradle underface 44*b*, reinforcing ribs 82 located on the upper surface 44*a* of cradle 44, and ridges 47 are all longitudinally aligned, and consequently cradle 44 is not significantly hampered in its transverse bending, i.e. when bending along a longitudinal axis, and thus it will not hamper the desired transverse flexing of boss 58 under loaded conditions. However, ribs 72, ribs 82 and ridges 47 hamper the longitudinal flexibility of cradle 44, i.e. they help prevent undesired bending of cradle 44 along a transverse axis.

The advantages of the snowshoe according to the present invention can be summarized as follows:

a) The semi-flexible pivotal hinged attachment of cradle 44 to decking 30 allows snowshoe 10 to resist to greater loads, especially loads which would induce unevenly distributed stresses in the area of the first and second hinge members, for example when the snowshoe rests on locally uneven ground terrain and is loaded with the person's weight. If a completely rigid hinge member, such as a prior art metallic rod, were to be used, important stress concentrations would be induced in the decking 30, and thus the latter would have to be thicker to resist such stress concentrations, resulting in a more expensive, less flexible and heavier snowshoe.

b) The hinged attachment of cradle 44 to decking 30, in combination with the engagement of fingers 70 in apertures 74, enhances the lateral stability of cradle 44 on decking 30, thus significantly helping to prevent undesirable misalignment of the person's foot relative to the snowshoe during gait.

c) The production of snowshoe 10, including the above-mentioned hinged attachment of the cradle 44 to the decking 30, is rather simple and inexpensive, since a relatively thin decking 30 can be used (i.e. less material required), and no additional hinge parts have to be made: the first and second hinge members are integrally molded on the monolithic decking 30 and the monolithic cradle 44 respectively.

d) The overall weight of snowshoe 10 is low, since the decking 30 can be relatively thin, as noted hereinabove, and since only plastic parts are used—no heavier metallic parts are required.

e) Since decking 30 is attached to frame 12 in a conventional manner, i.e. with filament ties 32, and since the hinge members do not include any rods or similar parts which require to be attached directly to the frame 12 (such as some prior art pivot rods), the decking 30 according to the present invention can be installed on any conventional snowshoe frame, as long as it is sized to fit thereon. Thus, it is envisioned that deckings according to the present invention, in combination with harnesses according to the present invention, be produced independently to be sold to snowshoe manufacturers, who could then install the deckings and harnesses on their own frames.

f) Harness 42 can be easily attached to and removed from decking 30, since no tools or bolts are required, which allows the initial installation and any replacement to be easily accomplished, as well as repair and maintenance of the snowshoe. Thus, a snowshoe owner can have different harnesses to fit onto his decking, depending on the snow conditions which could result in boots of different sizes to be worn, e.g. larger and warmer boots in colder conditions. Moreover, carrying the snowshoes on one's backpack or directly attached to a person's back, is facilitated by removing the harnesses, thus allowing the snowshoes of a pair of snowshoes to be flatly engaged against each other in an uncumbersome fashion, when being thus carried. For example, this is advantageous for persons who practice so-called freetrail snowboarding, wherein these persons will alternate between wearing snowshoes to walk uphill in the snow, and a snowboard to slide down the hill, the snowshoes being carried on the person's back while going down the hill on the snowboard.

g) Since only plastic parts are provided on the decking 30 and cradle plate 44 combination, the snow is not likely to stick to thereto. This would not be the case for example if metallic parts were used, since snow sticks to metallic parts more than it does to plastic. This is an important consideration, because snow can clog the interlocking hinge members and hamper significantly their operation, and such clogging is less likely to occur if only plastic parts are used.

Any modifications to the present invention, which do not deviate from the scope thereof, are considered to be included therein.

For example, cradle 44 has been shown as being selectively removable from decking 30, but it is understood that it could be attached thereto in a pivotable although non-removable fashion. Thus, in the present application, when mention to the combination of a decking with a harness is made, it must be understood that the harness may or may not be removable from the decking. The preferred way to carry out the invention however remains to provide a removable harness.

Also, decking 30 has been shown as having a generally rectangular shape, with two frontwardly extending arms 34, 36 defining the toe hole therebetween, but it is understood that the decking may be shaped to accommodate the general configuration of any suitable snowshoe frame.

Harness 42 is illustrated and described as comprising a forefoot cradle plate 44 and a strap member 48, but it is understood that the semi-flexible cradle could include any suitable foot rest, including but not limited to a full casing having a rear opening for entry therein of the foot.

It is envisioned that the first and second hinge members be configured according to different embodiments than the one shown in the drawings. For example, the first and second hinge members could be inverted in their positions, i.e. the lugs and arcuate seat could form part of the decking first hinge member, while the arcuate boss could be part of the cradle second hinge member, to engage each other in a similar manner than as shown in the drawings. Other minor modifications may also be brought to the first and second hinge members, without departing from the scope of the invention.

What is claimed is:

1. In combination, a semi-flexible snowshoe decking for attachment to a snowshoe, and a harness for releasable engagement therein of a person's foot, said semi-flexible decking being substantially flat and defining a front and a rear end portions, said decking comprising a toe hole and a first hinge member integrally formed in said decking and located rearwardly adjacent to said toe hole;

said harness having a semi-flexible foot cradle for resting the person's foot thereon and an attachment member carried by said foot cradle for releasable attachment of said harness to the person's foot, said cradle defining a front and a rear end portions and comprising a second hinge member integrally formed in said cradle intermediate said front and rear end portions; wherein said second hinge member is operatively mounted to said first hinge member for relative movement of said cradle relative to said decking between a first limit position, in which said cradle rear end portion abuts against said decking and in which said cradle front end portion is generally located over said toe hole, and a second limit position, in which said cradle extends through said toe hole with said cradle rear end portion extending spacedly over said decking and with said cradle front end portion extending through and beyond said toe hole; and wherein due to the intrinsic flexibility of said cradle and of said decking, said first and second hinge members will yieldingly yet resiliently flex under loads being applied thereon, to more evenly distribute stresses induced therein.

2. The combination as defined in claim 1, wherein said second hinge member is operatively pivotally mounted to said first hinge member to allow pivotal displacement of said cradle between said first and second limit positions.

3. A combination as defined in claim 2, wherein said cradle and said decking are made from a semi-flexible plastic material.

4. A combination as defined in claim 3, wherein said first hinge member comprises an elongated boss integrally formed transversely in said decking, said boss being semi-cylindrical and defining an upwardly convex upper surface and a downwardly concave lower surface, and wherein said second hinge member comprises a cylindrical lug member and an arcuate seat spacedly adjacent to and coaxial with said lug member, said boss being sized to fit between said lug member and said seat for sliding releasable engagement therebetween, said harness thus being selectively manually removable from said decking.

5. A combination as defined in claim 4, wherein said cradle comprises a substantially flat sheet member that defines an upper and a lower surface, said second hinge member being provided on said cradle lower surface and said cradle being provided with longitudinal toothed ridges on its lower surface frontwardly of said second hinge member, for gripping engagement on the snow during gait.

6. A combination as defined in claim 5, wherein said lug member comprises a few axially aligned, spaced-apart cylindrical lugs.

7. A combination as defined in claim 6, wherein said cradle comprises a few openings each located over a corresponding lug, for enhancing the flexibility of said cradle in the area adjacent said second hinge member, and for facilitating the production manufacturing moulding of said cradle.

8. A combination as defined in claim 7, where said cradle further comprises a number of longitudinally aligned reinforcing ribs located on each side of said openings, for enhancing the longitudinal rigidity of said cradle to help prevent accidental bending about a transverse axis, while not hampering the transverse flexibility of said cradle to allow said cradle to bend about a longitudinal axis.

9. A combination as defined in claim 5, wherein said cradle front end portion includes an abutment shoulder for abutment thereon of the foremost portion of the person's foot.

10. A combination as defined in claim 5, wherein said cradle lower surface comprises a few cleats, to further enhance the gripping action of said cradle during gait.

11. A combination as defined in claim 5, wherein said cradle upper surface is provided with studs, to prevent the person's foot from accidentally sliding on said cradle upper surface.

12. A combination as defined in claim 2, wherein said decking defines an upper surface and a lower ground-bearing surface, said lower surface being provided with a number of cleats projecting therefrom.

13. A combination as defined in claim 12, wherein said decking upper surface includes a number of studs to prevent the person's foot from accidentally sliding on said cradle upper surface.

14. A snowshoe for releasable attachment to a person's foot, comprising:

a closed rigid loop frame having a longitudinal axis;

a semi-flexible, substantially flat decking attached inside said loop frame, said decking defining a front and a rear end portions and comprising a toe hole and a first hinge member integrally formed in said decking and located rearwardly adjacent to said toe hole;

a harness having a semi-flexible foot cradle for resting the person's foot thereon and an attachment member carried by said foot cradle for releasable attachment of said harness to the person's foot, said cradle defining a front and a rear end portions and comprising a second hinge member integrally formed in said cradle intermediate said front and rear end portions; wherein said second hinge member is operatively mounted to said first hinge member for relative movement of said cradle relative to said decking between a first limit position, in which said cradle rear end portion abuts against said decking and in which said cradle front end portion is generally located over said toe hole, and a second limit position, in which said cradle extends through said toe hole with said cradle rear end portion extending spacedly away from said decking and with said cradle front end portion extending through and beyond said toe hole; and wherein due to the intrinsic flexibility of said cradle and of said decking, said first and second hinge members will yieldingly yet resiliently flex under loads being applied thereon, to more evenly distribute stresses induced therein.

15. The snowshoe as defined in claim 14, wherein said second hinge member is operatively pivotally mounted to said first hinge member to allow pivotal displacement of said cradle between said first and second limit positions.

16. A snowshoe as defined in claim 15, wherein said cradle and said decking are made from a semi-flexible plastic material.

17. A snowshoe as defined in claim 16, wherein said first hinge member comprises an elongated boss integrally formed transversely in said decking, said boss being semi-cylindrical and defining an upwardly convex upper surface and a downwardly concave lower surface, and wherein said second hinge member comprises a cylindrical lug member and an arcuate seat spacedly adjacent to and coaxial with said lug member, said boss being sized to fit between said lug member and said seat for sliding releasable engagement therebetween, said harness thus being selectively manually removable from said decking.

18. A snowshoe as defined in claim 17, wherein said cradle comprises a substantially flat sheet member that defines an upper and a lower surface, said second hinge member being provided on said cradle lower surface and said cradle being provided with longitudinal toothed ridges on its lower surface frontwardly of said second hinge member, for gripping engagement on the snow during gait.

19. A snowshoe as defined in claim 15, wherein said decking is formed from a full substantially flat sheet member, and wherein said loop frame further comprises a front and a rear crossbar transversely extending therein and defining a central area between said front and rear crossbars in which said decking is installed, a front area frontwardly of said front crossbar in which an additional front decking is installed, and a rear area rearwardly of said rear crossbar in which an additional rear decking is installed.

* * * * *